United States Patent [19]

Gilpatrick

[11] Patent Number: 5,015,849

[45] Date of Patent: May 14, 1991

[54] INDEX MARKING SYSTEM

[75] Inventor: Michael W. Gilpatrick, Chesnee, S.C.

[73] Assignee: Milliken Research Corporation, Spartanburg, S.C.

[21] Appl. No.: 450,877

[22] Filed: Dec. 14, 1989

[51] Int. Cl.[5] ..... G01N 21/31

[52] U.S. Cl. ..... 250/302; 250/308; 250/548

[58] Field of Search ..... 250/302, 303, 308, 548, 250/557; 26/70

[56] References Cited

U.S. PATENT DOCUMENTS

| | | | |
|---|---|---|---|
| 3,497,702 | 2/1970 | Martensson et al. | 250/548 |
| 3,933,094 | 1/1976 | Murphy et al. | 101/426 |
| 4,103,177 | 7/1976 | Sanjord et al. | 26/70 |
| 4,209,708 | 6/1980 | Galimberti mee Sestini | 250/548 |
| 4,392,056 | 7/1983 | Weyandt | 250/548 |
| 4,451,521 | 5/1984 | Kaule et al. | 250/461.1 |
| 4,471,217 | 9/1984 | Engel | 235/468 |
| 4,531,851 | 7/1985 | Kondo et al. | 250/548 |
| 4,574,194 | 3/1986 | Coats et al. | 250/505.1 |
| 4,853,776 | 8/1989 | Itaya et al. | 26/70 |
| 4,896,605 | 1/1990 | Schröder | 250/548 |
| 4,904,875 | 2/1990 | Shankel | 250/302 |

*Primary Examiner*—Jack I. Berman
*Assistant Examiner*—Kiet T. Nguyen
*Attorney, Agent, or Firm*—Kevin M. Kercher; H. William Petry

[57] ABSTRACT

A detection system is disclosed for detecting the presence of a marking material placed on a textile substrate prior to a series of dyeing and finishing steps. Following such steps, the substrate carrying the marking material is illuminated by light having a preferred wavelength of about 900 nanometers. The light is preferably absorbed by the marking material, thereby reducing the amount of light reflected from the substrate carrying the marking material and triggering an alarm. In a preferred embodiment, the marking material contains carbon particles.

15 Claims, 4 Drawing Sheets

INDEX MARKING SYSTEM

This invention relates to a system for marking substrates and detecting such substrate marks. In particular, in a preferred embodiment, this invention is directed to a detection system whereby a marking material containing carbon particles, applied to a textile substrate prior to a series of textile dyeing and finishing steps, may be detected following completion of such dyeing and finishing steps, even if such steps have rendered the mark invisible to the naked eye.

In the manufacture of textile fabrics, certain defects are commonly produced by (or become apparent on) the fabric forming machines which produce the fabric (looms, knitting machines, etc.). Such defects usually result in, or are caused by, the stoppage of the machine, which can occur either automatically or due to the intervention of an operator. At the time the fabric forming machine is stopped, a defect in the fabric may or may not be apparent to the machine operator or trained observer. At the fabric formation stage, the fabric usually has to undergo a great many subsequent manufacturing steps before it is ready for delivery to the customer. Such steps, which may include washing, shearing, dyeing, etc., frequently tend to obscure, and may render entirely invisible, not only any defects which may have been the cause or result of a machine stoppage, but any marks or other indicators used by the operator to identify the location of such machine stops or manufacturing defects.

Accordingly, it is often exceedingly difficult to mark the location of a defect or machine stop at the fabric formation stage in a way which, on the one hand, will not exaggerate the visual impact of any defect in the finished fabric, yet can be dependably observed following the completion of the manufacturing process, i.e., following the washing, shearing, dyeing, or other mark-obscuring processes to which textile fabrics are commonly subjected during the course of manufacture. Because subsequent manufacturing steps tend to obscure, but not eliminate, fabric formation.generated manufacturing defects. it is important to be able to determine the location of such defects at the conclusion of the manufacturing process so that the inspector can locate and evaluate the ultimate visual severity of such defects in the finished textile product.

The detection of defect locations in a fabric inspection process is made even more difficult by the fact that fabric is typically inspected by passing the fabric at a relatively high rate of speed past a human inspector stationed at a well lighted inspection station. The inspector must look for a wide variety of defects (e.g., machine stop marks, dyeing irregularities, soiling, etc.) while the fabric is moving past the inspection station at a linear speed of perhaps forty to one hundred yards per minute. For these reasons, any marks which were placed on the fabric at the fabric formation stage for the purpose of alerting the inspector to a fabric formation originated defect are likely to risk going undetected.

The invention disclosed herein may be used to address this problem. It has been discovered that a marking material can be applied to a fabric at the fabric formation stage, and can be detected reliably following completion of the fabric manufacturing process using an active optical detector as disclosed herein. The detector contemplated herein is intended to operate with illumination which has been transmitted by an associated emitter and reflected from the fabric. When the emitter illuminates a portion of the substrate containing a carbon.containing marking material contemplated herein, the carbon absorbs the incident light, preventing a strong reflected signal from entering the detecting portion of the sensor. The lack of reflected signal of sufficient strength to exceed a predetermined threshold level initiates the alarm mode, which may or may not include the slow-down or stopping of the substrate. The marking material (that is, the "ink" ) to be applied to the fabric at the fabric forming stage must have the characteristic that it is detectable (though not necessarily visible to the naked eye) even after the fabric has gone through all of the subsequent processes between fabric formation and final inspection.

To be detectable, (a) a sufficient amount of the marking material must adhere to the fabric in the area where it originally was placed, and (b) sufficient contrast must exist between the mark and the surrounding background. Many commercially available marking fluid compositions, commonly referred to as "permanent" markers, will satisfy requirement (a). Experience has shown, however, that requirement (b) is, in practice, more difficult to meet. It has been found that inks containing carbon particles exhibit a strong absorption to electromagnetic radiation in the region extending from the visible region through the near infrared (i.e., from visible through about 1500 nanometers), as well as in the non-visible region, particularly in the area between 900 and 1100 nanometers. Moreover, it has been found that virtually all textile fabrics, whether undyed or dyed using conventional commercial dyeing techniques, and regardless of composition, reflect strongly (though not completely) in this latter region (even fabrics which have been dyed deep black). Thus, if an ink containing carbon is used to place a mark on a fabric which is later illuminated by near infrared radiation, such as that produced by so-called light emitting diodes ("LED's" ), such radiation will be reflected by fabric which has not been so marked, and will be absorbed by the areas of the fabric containing the mark.

In a preferred embodiment, the marking material is comprised of a mixture or suspension of carbon particles of perhaps five to ten per cent by weight, although higher or lower percentages of carbon may be preferred under some conditions, and the detector has a sensitivity peak at a wavelength of about nine hundred nanometers. The carbon particles, in a suitable vehicle (e.g., a crayon, paint, ink, or the like) may be applied to the side portion (e.g., selvedge) or to the edge of the fabric by the fabric formation machine operator directly opposite the location of a defect, or other index to be noted by the finished fabric inspector. Through the use of an automated detector system which is specifically designed to detect carbon particles along the side portion or edge of a web of fabric traveling at relatively high speed, the inspector of the finished fabric can rely on the detector to alert him to those locations near or along the length of the web of fabric which correspond to the location of defects noted and marked during the fabric formation stage.

Accordingly, the operator may inspect the fabric for certain defects, e.g., shade defects, at relatively high speeds, while relying on the detector (and associated alerting system) to alert him to the presence of a fabric formation-type defect. At such time, the operator can manually decrease the speed at which the fabric is passing the inspection station to more accurately assess the visibility and severity of the defect. In a preferred embodiment, fabric speed can be automatically adjusted. Alternatively, fabric travel can be stopped altogether, perhaps following a predetermined delay, so the fabric portion associated with the mark (and containing the defect) is positioned directly in front of the inspector, e.g., opposite a stationary index mark. This allows the operator to inspect the fabric at higher speed than would otherwise be practical by allowing the operator to focus his attention more fully on defects having other origins, e.g., uneven application of dye.

Further details and advantages of this invention will become apparent from the detailed description below, when read with the accompanying Figures, in which FIG. 1 is an overall side view of an inspection frame for inspecting a moving web such as a textile web, which schematically depicts detector assembly 24 associated with the instant invention;

DESCRIPTION OF A PREFERRED EMBODIMENT

Figure 1:
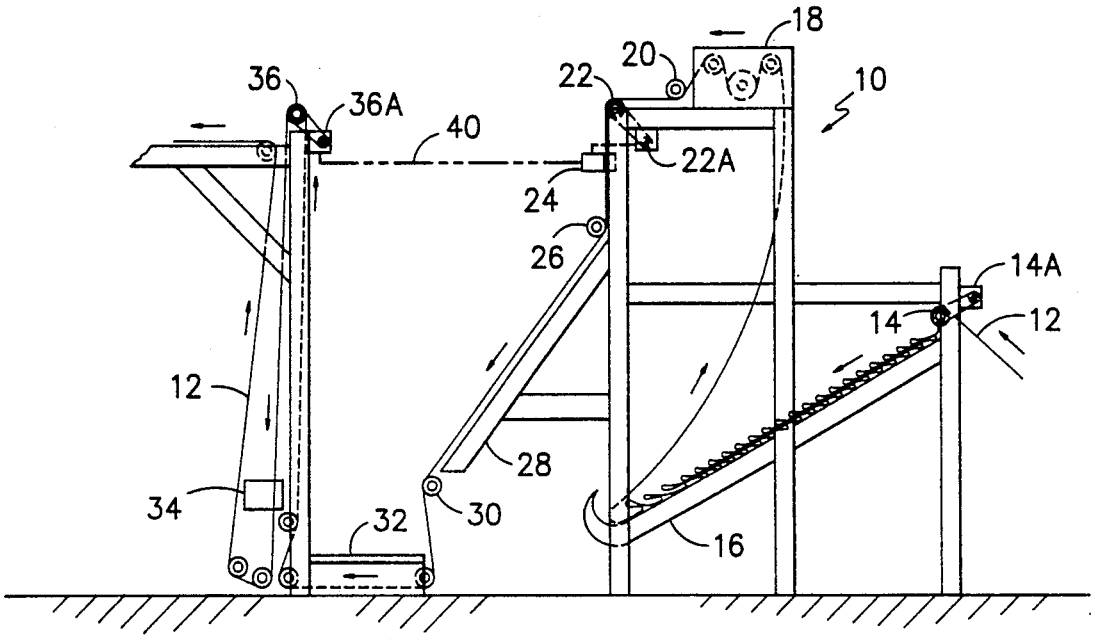

Referring now in more detail to the drawings, FIG. 1 depicts a substantially conventional inspection frame 10 for a web 12 of textile fabric or the like. Fabric web 12 is pulled into frame 10 by driven roll 14, whereupon it is accumulated in scray 16 awaiting transport across inspection board 28 by way of guider assembly 18, roller 20, and driven roll 22. Driven roll 36 serves to pull web 12 past detector assembly 24, across inspection board 28 and under platform 32, on which an inspector can observe fabric web 12 as it moves across inspection board 28. Fabric web 12 passes through another guider assembly 34, and then, via appropriate rolls, is sent to the next manufacturing area. Each driven roll 14, 22, and 36 has associated with it a respective drive means 14A, 22A, and 36A, which determines the speed of the respective roll. In a preferred embodiment, drive means 22A and 36A are associated with a control path, depicted schematically at 40, by which detector assembly 24 may control the speed of (as well as stop and start) the driven rolls associated with such drive means.

Figure 2:
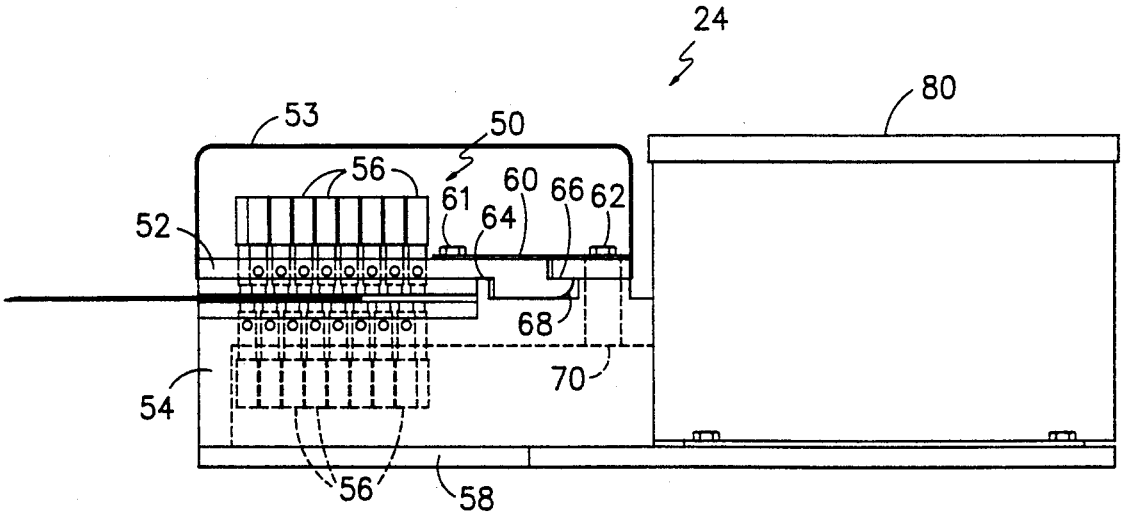
FIG. 2 is an elevation view, in partial section, of one embodiment of the detector assembly 24.
Figure 3:
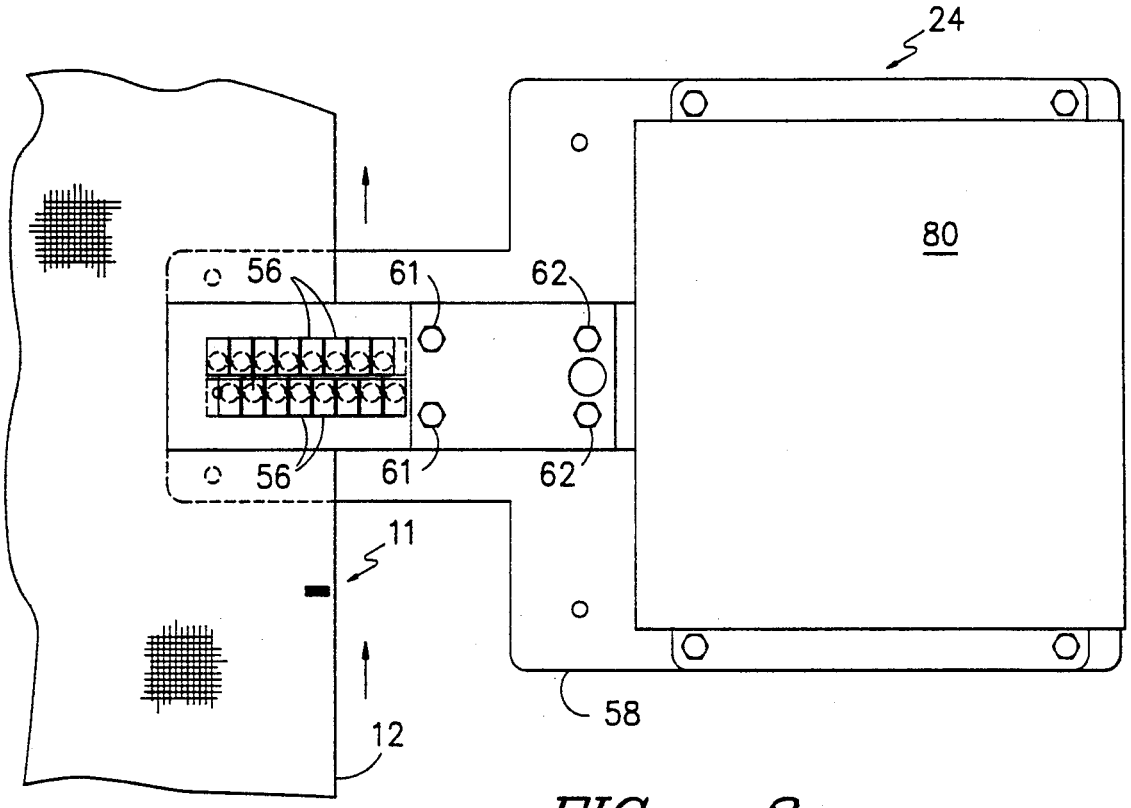
FIG. 3 is a plan view, in partial section, of the detector assembly 24 of FIG. 2, showing the staggered mounting arrangement of the individual detectors.
Figure 4:
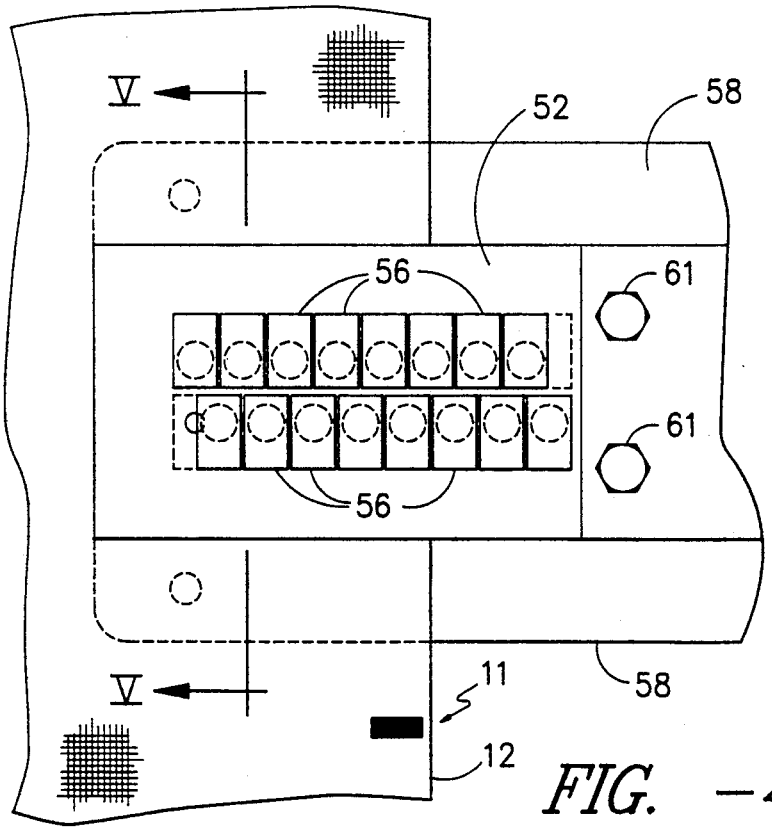
FIG. 4 is a detail of the view of FIG. 3.

As depicted in FIG. 2, assembly 24 can be divided into a detector array sub-assembly 50, comprised of upper and lower detector arrays, and an amplifier sub-assembly, indicated generally at 80. Sub-assembly 80 and related logic/control circuitry 83 are described in more detail in FIG. 7, and are discussed following a discussion of the details of detector sub-assembly 50.

As shown in FIGS. 2-5, the detector array subassembly 50 is comprised of two opposing, closely spaced arms 52,54 into which opposing rows of individual detector modules 56 have been placed. Lower arm 54 carries two parallel, but staggered, rows or linear arrays of upward looking individual detector modules 56 (hereinafter, "lower detector arrays" ), and is preferably fixed in position to a rigid base 58, by which detector assembly may be suitably mounted on or near inspection frame 10. As indicated in FIGS. 2 through 5, lower arm 54 is preferably positioned so that the two lower detector arrays are in close proximity to, and substantially parallel with, the underside of the fabric 12 to be inspected.

As shown in FIG. 2, upper arm 52 is positioned directly opposite to, and in generally parallel alignment with, lower arm 54, thereby forming an elongate gap having a preferred spacing of less than about 0.5 inch. Upper arm 52 carries two parallel, but staggered, rows or linear arrays of downward looking individual detector modules 56 (hereinafter, "upper detector arrays" ), as well as protective cover 53. Each array is suitably positioned so that at least several (but not most) of the detector modules comprising both the upper and lower detector arrays are positioned beyond the outside edge of the fabric web. This is advantageous to assure that an effective number of detector modules are in fact positioned opposite those areas of the fabric most likely to contain the marks 11 to be detected, i.e., those placed on or near the fabric selvedge by the fabric formation machine operator.

Unlike lower arm 54, upper arm 52 is not rigidly mounted, but instead is mounted, via mounting bolts 61,62 on a hinge comprised of leaf spring 60. In conjunction with motion stops 64 and 66, leaf spring 60 provides for a limited amount of vertical motion by virtue of the pivoting of the upper arm about a center point located near 68. Leaf spring 60 maintains the upper detector arrays in substantially parallel alignment with both the surface of fabric web 12 and the two lower detector arrays, while allowing upper arm 52 to pivot sufficiently to allow the edge of fabric web 12 to be inserted easily within the gap formed by the upper and lower arms. Channel 70, leading to a space between lower arm 54 and base 58, may be used as a wire conduit to accommodate the various input/output leads associated with upper detector modules 56. Connections with amplifier sub-assembly 80 may be made through a suitable aperture, not shown, leading from the space between lower arm 54 and base 58.

Figure 5:
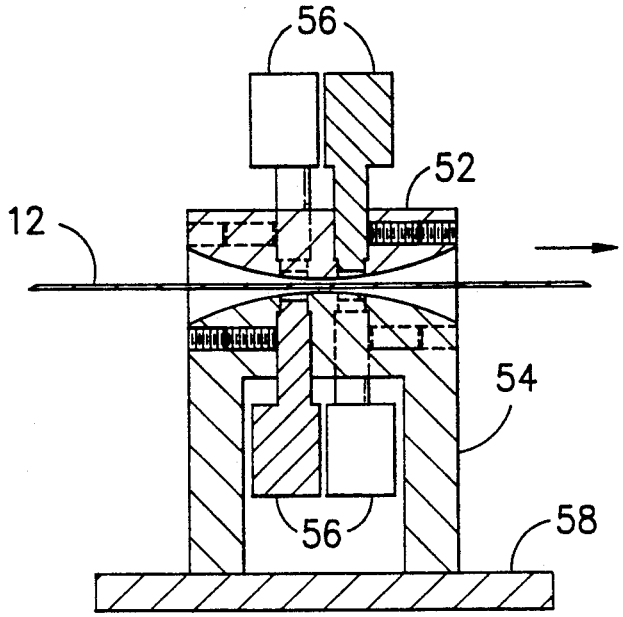
FIG. 5 is a section view of the detector assembly of FIG. 4, as seen along lines V—V of FIG. 4.

The incoming and outgoing surfaces presented to the fabric of both upper and lower arms are preferably machined to a smooth radius, as shown in FIG. 5, in order to facilitate fabric insertion ("thread-up" ) and passage through the detector gap formed by the opposed upper and lower arms 52,54. The sensors themselves should be recessed into the arms in such a way that the distance between them and the surface of the fabric being viewed, once set, should not decrease. Such decrease could cause an increased level of detected radiation reflected from the marked portions of the fabric simply by virtue of the decreased distance, in effect decreasing the apparent contrast between marked and unmarked areas. Additionally, by virtue of rocker surface 68, this arrangement can readily accommodate seams, creases, or other conformational irregularities which may exist in the fabric as it passes under the sensor at high speed. Upon encountering such irregularity, upper arm 62 is merely pushed out of the way temporarily. allowing the seam, crease, etc. to pass and allowing the distance between the detector and the fabric surface to be maintained, at least approximately. Leaf spring 60, in conduction with motion stops 64,66, provides a means for upper arm 62 to return to its original spaced position parallel to the surface of the fabric web.

As depicted in FIGS. 2–5, in a preferred embodiment upper and lower detector arrays are comprised of individual detector modules 56. Individually, modules 56 are comprised of (1) a source of radiation with which the fabric may be illuminated within the field of view of the radiation detecting unit, mounted in association with (2) a corresponding radiation detecting sensor unit, for detecting radiation reflected from the fabric surface. In practice, the emitter and respective detector of the radiation are usually "matched" , that is, the peak of the characteristic output spectral intensity curve for the emitter is made to coincide as closely as possible with the peak of the spectral sensitivity characteristic curve of the detector. Moreover, the spectral characteristics of both the emitter and the detector are advantageously made as sharply peaked as possible, so as to eliminate the detection of spurious signals outside the wavelength range of interest.

For the purpose of detecting a marking material containing carbon particles, it has been found that light having a wavelength of approximately nine hundred (900) nanometers is particularly effective. Accordingly. in a preferred embodiment, detector modules which illuminate and detect such reflected illumination at or near this wavelength have been found to be particularly effective. Suitable detector modules in which the sensor and the source of illumination are individually paired and coaxially configured, and which have the advantage of a relatively small, compact design, are distributed by Skan-A-Matic Corporation of Elbridge, N.Y. as Model 32204. It is foreseen that other detector modules, having other configurations (e.g., a common illumination source used with individual sensors, etc.), could be preferred under some conditions. Because the preferred detector modules contain individual, coaxially-configured sources of illumination, it is recommended that the detector modules are mounted in a way which prevents the source of illumination of one detector module from shining directly into the detector portion of the opposite detector module. Accordingly, it should be noted that the detector modules 56 comprising upper and lower detector arrays are arranged in opposed but staggered relation, so that detectors in the upper array do not "look" directly into the corresponding opposed detector in the lower array, but rather into the reflective surface of the opposing arm, and vice versa.

Figure 6:
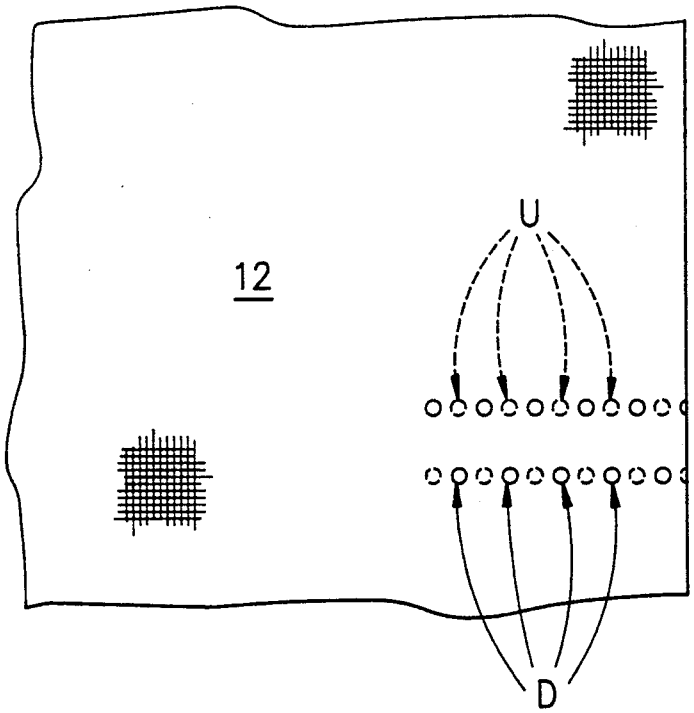
FIG. 6 is a schematic representation of a section of substrate as seen in FIG. 4, indicating the areas illuminated by individual detectors comprising the upper and lower detector arrays.

As can be determined from inspecting FIGS. 2–5, while the axes of the upper and lower detector arrays along the length of upper and lower arms are preferably in opposed alignment, the individual detector modules comprising the arrays are offset or staggered in two senses: (1) the two rows of detector modules comprising the upper and lower arrays are staggered within each respective array (along the length of arms 52,54), and (2) the upper detector array (comprised of two rows of detectors) is staggered or offset with respect to its lower counterpart (again, along the length of upper and lower arms 2,54). The result of this staggering is depicted in FIG. 6, which shows, in diagrammatic form, the illumination patterns of the detector modules as seen on the substrate depicted in FIG. 4. Full line circular patterns "D" represent the illumination pattern of the downward-looking (i.e., away from the reader) detector modules, while broken line circular patterns "U" represent the illumination pattern, on the opposite side of the substrate, of the upward.looking (i.e., toward the reader) detector modules. As can be seen, the individual downward and upward-looking detector modules are not coaxial with their vertically opposing counterpart, but instead are offset so the illuminator of one module does not shine directly into the sensor of an opposing module. If such were the case, the modules would "see" the incoming illumination of the opposed module as a reflection from the substrate. In cases where the substrate is loosely woven or is otherwise somewhat translucent to the illuminating light, the absorption of illuminating light by a mark would then "compete" with the transmission of similar illuminating light from the opposing module, thereby significantly reducing the practical sensitivity of the detection process.

The material comprising arms 52,54 is preferably reflective at the wavelength used by the sensors. For example, aluminum and stainless steel are suitable materials. Use of such material prevents false alarms from those sensors which do not illuminate the fabric. The localized region of the arms 52,54 which are directly opposite the extreme inboard and outboard sensors can be covered with a coating which absorbs radiation at the wavelength of interest (e.g., a carbon based coating or paint) if it is desired to alert the operator when the substrate edge is no longer properly aligned within the gap. In such case, the extreme inboard sensor which is opposite such coating would normally be configured to produce an alerting signal when the reflected light exceeds an appropriate threshold.

Figure 7:
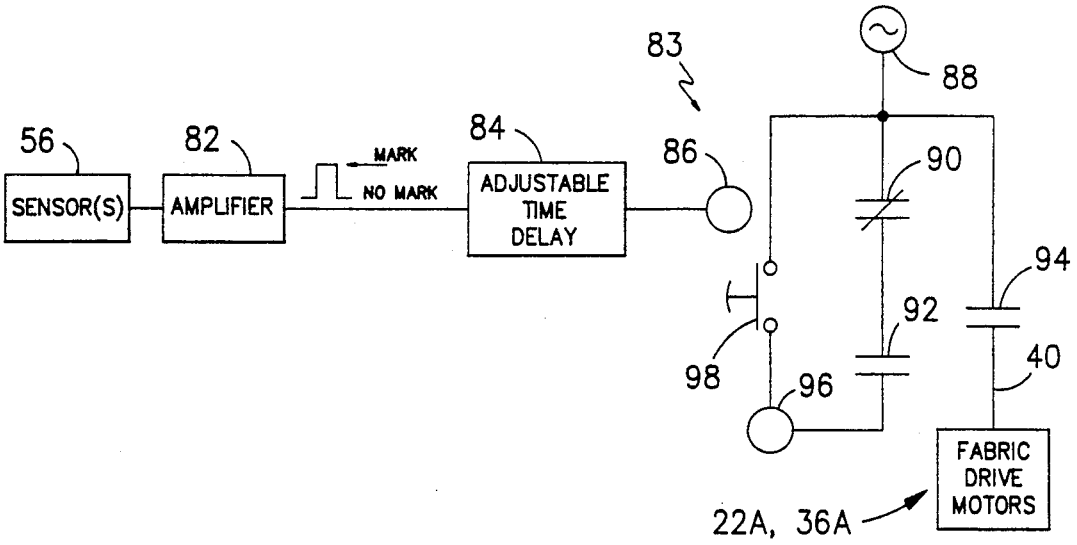
FIG. 7 is a schematic representation of the logic/control circuitry.

FIG. 7 shows, in schematic form, details of the logic/control sub-assembly 83. Each individual detector module 56 is connected to the input of a suitable photoelectric amplifier 82 (such as that distributed by Skan-A-Matic as Model T21104). This amplifier, which preferably incorporates a Schmitt Trigger or similarly acting circuit, provides positive switching and amplification of d.c. voltage levels which signify individual detector module "on" states. (Whether a mark is to be indicated by a logical "high" or logical "low" signal is a user option.) Adjustment of a threshold value useful in accommodating differences in reflectivity of different substrates can be accomplished by adjustments to the Schmitt Trigger circuit.

Fabric drive motors 22A, 36A are started by depressing pushbutton 98 which causes relay contacts 92 and 94 to close. The closure of contact 92 causes relay coil 96 to "latch" , i.e., to remain energized so long as both contacts 90 and 92 remain closed. The output of all amplifiers are "or" ed together, so that a signal from any one (or more) amplifiers causes a single signal to be sent to an adjustable time delay 84 of conventional design, which merely outputs a corresponding signal after a predetermined elapsed time following the arrival of the signal from the amplifier output. The delayed signal is routed to relay coil 86, whereupon normally closed contact 90 associated with coil 86 is made to open. This serves to interrupt the flow of current into relay coil 96, which in turn causes contacts 92 and 94 associated with coil 96 to open. Because contact 92 is open, relay coil 96 cannot be energized and contacts 92 and 94 remain open, thereby cutting power from power source 88 to driven roll motors 22A and 36A (see FIG. 1). The power remains interrupted until momentary contact pushbutton 98 is depressed, which re-energizes coil 92 and causes driven roll motors 22A and 36A to restart.

The amount of time delay used in the adjustable time delay circuit is dependent upon the fabric speed normally used, as well as the distance downstream from the point of mark detection that the fabric must travel before coming to a halt. It is anticipated that the sensor array would be used somewhat upstream of a fabric inspection point. By using such an arrangement, the inspector would be alerted that (1) a defect mark had indeed been detected, and, by means of an index mark on the inspection table, (2) the general area of the substrate within which such mark was detected.

The foregoing description sets forth one possible embodiment of the control circuitry. The components comprising this circuitry 83 can be placed in an appropriate housing in any appropriate location near the inspection frame. for example, adjacent to assembly 24. Push button 98, not shown in FIG. 1, should be within easy reach of the inspector. More elaborate control schemes could be used which, for example, would cause the time delay to be automatically established, based upon a fabric speed which may be variable. Alternatively, control strategies based upon fabric movement sensors (so-called automatic yardage counters) could be used instead of the time delay circuit described above to allow the de.energization of the fabric drive motor after a predetermined length of fabric had been sensed subsequent to the detection of the defect mark by the sensor array. In light of the teachings herein, other alternative embodiments may be apparent to those skilled in the art.

Figure 8:
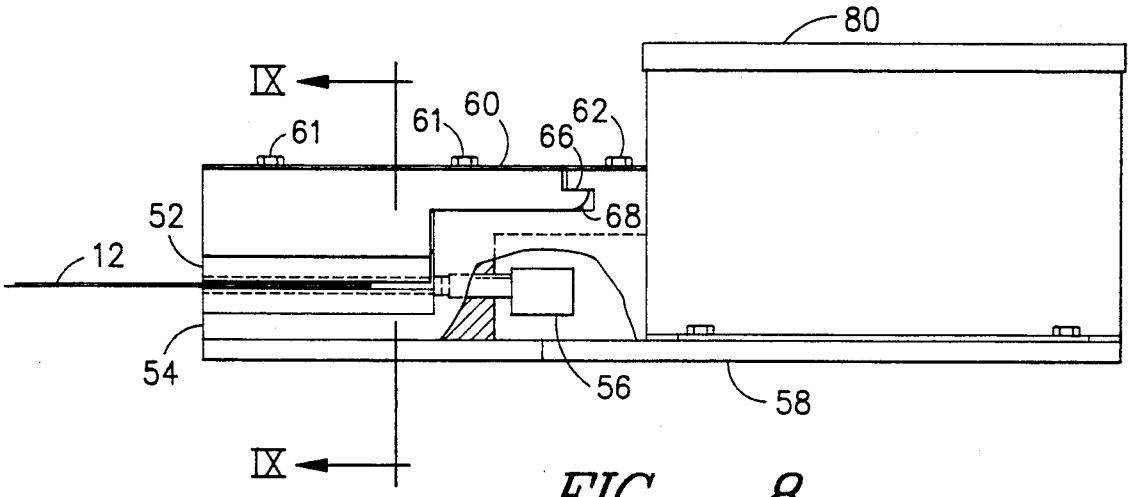
FIG. 8 is an elevation view, in partial section, of an alternative embodiment of the detector assembly, adapted for detecting marks on the edge of a substrate.
Figure 9:
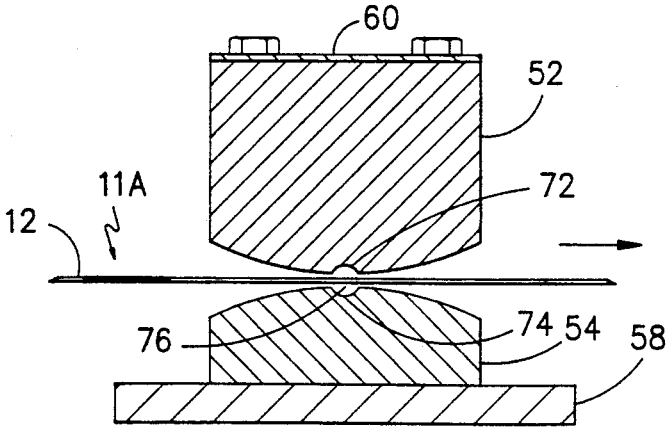
FIG. 9 is a section view of the detector assembly of FIG. 8, as seen along lines IX—IX of FIG. 8.

FIGS. 8 and 9 show an alternative embodiment of the detector array subassembly 50 of FIGS. 2–5, which embodiment has been adapted to detect marks of the kind contemplated herein which have been placed along the actual edge of a substrate, as opposed to a portion of the surface of the substrate along the side of the substrate, e.g., the selvedge area. This embodiment is of interest in situations where the substrate has no selvedge or other expendable edge portion, and/or it is desired to identify the location of a substrate defect without making a mark on the actual surface of the substrate. Preferably, the substrate will have sufficient thickness to carry a detectable quantity of the marking material.

As shown in FIGS. 8 and 9, this embodiment has an external configuration similar to the embodiment shown in FIGS. 2 through 5, except that, in place of the pairs of opposed arrays, a single detector module 56 or illuminator/sensor pair, oriented to view substrate 12 "edge-on," is used. The opposing inner surfaces of upper and lower arms 52, 54 are adapted with a respective small, smooth.walled groove or channel 72,74 of generally circular cross-section extending axially along the length of the respective arms 52,54, to provide a bore sight 76 for outwardly directed detector module 56 within the confines of the gap formed by the upper and lower arms 52, 54. It can be seen from FIGS. 8 and 9 that radiation emitted by the sensor can travel in a direct line-of-sight direction to the edge of the substrate, as well as undergoing multiple reflections from the walls forming the channels 72,74. Such multiple reflections serve to increase the level of illumination of the fabric edge. Conversely, radiation reflected by the unmarked fabric 12 can pass either directly, or through multiple reflections, back to the sensor. The effect of the multiple reflections of both the incident and reflected radiation is to increase the overall sensitivity of the device. This helps to prevent the generation of spurious signals which could be interpreted as marks, but which in fact are due to insufficient illumination of unmarked fabric and/or insufficient reflected radiation from such fabric, i.e., the presence of multiple reflections tends to increase the effective signal-to-noise ratio of the device. Such situations can occur when, for example, the fabric edge is not sufficiently close to the sensor. To achieve this end, the material comprising the channels 22,24 is preferably highly reflective for radiation of the wavelength range of interest. This serves (1) to increase the illumination of the substrate edge by virtue of the multiple reflections of the emitted radiation by the channels 72,74, and (2) increase the amount of reflected radiation which is detected by the sensor 56. As in the previous discussion, a carbon.containing mark 11A on the edge of the fabric will absorb the incident radiation, and the decreased intensity of reflected radiation is the criterion for the detection of mark 11A.

It is recommended that, where the marks of interest are located along or near the edge of the fabric web, the instant invention be used in conjunction with a commercially available fabric edge guider, as indicated at 18 in FIG. 1. Such device, using optical, pneumatic, or other means, detects the location of the edge of the fabric and causes small changes in the lateral position of the fabric to keep constant the relative position of the fabric edge with respect to the inspection frame (or with respect to the location of the detector). As before, upper arm 52 may be resiliently positioned by means of a leaf spring 60 or other means to allow limited, and self-returning, motion to accommodate seams or other conformational irregularities.

EXAMPLE 1

A swatch of polyester woven fabric, light blue in color, was marked in a small area using a permanent marker ("Sharpie" permanent marker distributed by Sanford's of Bellwood, Ill.). Such a marker contains approximately 5% by weight of carbon black pigmenting agent. A single Model 51104 sensor manufactured by Skan-A-Matic Corporation, Elbridge, NY 13060, oriented to observe an area of the fabric surface containing the mark, was used. It was found that, when the sensor amplifier was wired so as to activate a small piezoelectric buzzer when the detected radiation was below a preset threshold, passage of the area of the fabric so marked through the "view" of the sensor resulted in the activation of the alarm buzzer. At the same sensitivity level, when the sensor viewed unmarked areas of the fabric, no activation of the alarm buzzer occurred.

EXAMPLE 2

Using the marker and sensor of Example 1, a swatch of undyed 100% polyester pile fabric was marked on its surface, and then dyed a deep black color in a laboratory dyeing machine. Although the marked area was indistinguishable to the human eye following the dyeing operation, the detector was able to detect the presence of the mark as in Example 1.

EXAMPLE 3

A swatch of woven polyester fabric was marked in different areas with the marker of Example 1, as well as with: (a) a permanent "felt tip" pen, made by Sanford, containing an undisclosed amount of carbon black, and (b) a black textile resist pen manufactured by Marktex, Inc. of Englewood, NJ, containing approximately 9% by weight of carbon black pigment. The fabric was then dyed to a maroon color. The marks were barely visible to the naked eye. The results when using the sensor of Example 1 were as in Example 1.

I claim:

1. A process for detecting reference locations on a moving textile substrate, comprising:

a. marking said substrate at a desired reference location with a marking material which exhibits selective absorption to light within a relatively narrow range of the non-visible spectrum and said substrate is substantially nonabsorptive of the non-visible light;

b. illuminating said substrate with light having a spectrum which includes said relatively narrow range of the non-visible spectrum;

c. sensing, within said narrow range of the non-visible spectrum, said illuminating light as said light is reflected from said substrate;

d. triggering a response whenever the intensity of said reflected light is reduced below a threshold level due to absorption of said light by said marking material.

2. The process of claim 1 which further comprises retarding the motion of said moving substrate whenever said response is triggered to allow extended visual inspection of said substrate.

3. The process of claim 1 wherein said marking material contains carbon black, and wherein said narrow range of said non-visible spectrum is centered at a wavelength of about 900 nanometers.

4. The process of claim 1 wherein said substrate is a textile fabric, and wherein said substrate is marked at selected locations within the selvedge of said textile fabric.

5. The process of claim 1 wherein said substrate is a textile fabric, and wherein said substrate is marked at selected locations along the edge of said substrate.

6. The process of claim 1 wherein said substrate is a textile fabric, and wherein said substrate is marked by means of a yarn containing said marking material.

7. The proess of claim 1 wherein said substrate is a textile fabric, and wherein said substrate is marked by means of a yarn containing carbon black, said yarn being incorporated into said fabric.

8. An apparatus for detecting reference marks which have been placed on a relatively moving web wherein said marks are comprised of a material which preferentially absorbs light at a known, non-visible wavelength, said apparatus being comprised of the following:

a. at least one source of light at said known, non-visible wavelength, said light source being positioned to direct light onto said substrate and said substrate is substantially non-absorptive of non-visible light;

b. at least one sensor capable of sensing light at said known, non-visible wavelength, said sensor being positioned relative to said source so as to generate an output signal whenever said light directed onto said substrate by said light source is reflected into said sensor by said substrate;

c. logic means for triggering a response whenever said light reflected by said substrate into said sensor is below a threshold level, indicating the presence of a reference mark: and d. retarding means, operably associated with said logic means, for retarding the motion of said moving substrate whenever said response is triggered to allow extended visual inspection of said substrate.

9. The apparatus of claim 8 wherein said non-visible wavelength is about 900 nanometers.

10. The apparatus of claim 8 wherein said apparatus is comprised of a light source and sensor which is positioned to illuminate, and sense reflected light from, the edge portion of said moving substrate.

11. The apparatus of claim 8 wherein said apparatus is comprised of a plurality of light sources and sensors, said light sources and sensors being arranged in at least one array which illuminates said substrate in a plurality of localized areas which collectively extend inwardly from the edge of said substrate.

12. The apparatus of claim 11 wherein said plurality of light sources and sensors are arranged in a plurality of arrays, and wherein at least two of said arrays are positioned in opposed relation to allow opposite surfaces of the same area of said substrate to be illuminated.

13. The apparatus of claim 12 wherein said light sources and sensors comprising said opposed arrays are positioned within their respective arrays to prevent the light source from a given array from shining directly into a sensor from an opposing array.

14. An apparatus for detecting reference marks which have been placed on a relatively moving web wherein said marks are comprised of a material which preferentially absorbs light at a known, non-visible wavelength, said apparatus being comprised of the following:

a. at least one source of light at said known, non-visible wavelength, said light source being positioned to direct light onto said substrate;

b. at least one sensor capable of sensing light at said known, non-visible wavelength, said sensor being positioned relative to said source so as to generate an output signal whenever said light directed onto said substrate by said light source is reflected into said sensor by said substrate;

c. logic means for triggering a response whenever said light reflected by said substrate into said sensor is below a threshold level, indicating the presence of a reference mark;

d. retarding means, operably associated with said logic means, for retarding the motion of said moving substrate whenever said response is triggered to allow extended visual inspection of said substrate; and e. resilient positioning means for resiliently positioning said sensor within an operable distance from said substrate, said resilient positioning means providing for an increase in the thickness of said substrate while maintaining the separation between said sensor and said substrate, but further providing said sensor with a counteracting force tending to restore said sensor to said fixed distance.

15. An apparatus for detecting reference marks which have been placed on a relatively moving web wherein said marks are comprised of a material which preferentially absorbs light at a known, non-visible wavelength, said apparatus being comprised of the following:

a. at length one source of light at said known, non-visible wavelength, said light source being positioned to direct light onto said substrate;

b. at least one sensor capable of sensing light at said known, non-visible wavelength, said sensor being positioned relative to said source so as to generate an output signal whenever said light directed onto said substrate by said light source is reflected into said sensor by said substrate;

c. logic means for triggering a response whenever said light reflected by said substrate into said sensor is below a threshold level, indicating the presence of a reference mark;

d. retarding means, operably associated with said logic means, for retarding the motion of said moving substrate whenever said response is triggered to allow extended visual inspection of said substrate; and e. leaf spring for resiliently positioning said sensor within an operable istance from said substrate, said leaf spring providing for an increase in the thickness of said substrate while maintaining the separation between said sensor and said substrate, but further providing said sensor with a counteracting force tending to restore said sensor to said fixed distance.

* * * * *